US007526237B2

(12) United States Patent
Daigo et al.

(10) Patent No.: US 7,526,237 B2
(45) Date of Patent: Apr. 28, 2009

(54) ROTARY MOUNTING STRUCTURE FOR TONER CARTRIDGE

(75) Inventors: Hironori Daigo, Osaka (JP); Koji Murata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/258,107

(22) Filed: Oct. 26, 2005

(65) Prior Publication Data

US 2007/0092305 A1 Apr. 26, 2007

(51) Int. Cl.
*G03G 15/08* (2006.01)

(52) U.S. Cl. ..... 399/263

(58) Field of Classification Search ..... 399/263, 399/256, 258, 262

See application file for complete search history.

(56) References Cited

U.S. PATENT DOCUMENTS 5,489,976 A * 2/1996 Ichikawa ..... 399/263
5,715,502 A * 2/1998 Taniguchi et al. ..... 399/256
6,049,685 A * 4/2000 Murakami et al. ..... 399/263
6,137,972 A * 10/2000 Playfair et al. ..... 399/262
6,246,854 B1 * 6/2001 Kurosawa et al. ..... 399/263

* cited by examiner

*Primary Examiner*—David M Gray
*Assistant Examiner*—Ruth N Labombard
(74) *Attorney, Agent, or Firm*—Shinjyu Global IP

(57) ABSTRACT

A toner cartridge comprising a rotary 2 provided with an agitator 3 that agitates a toner, and a bearing that rotatably supports a shaft tip 6 of the rotary 2, comprises a retainer 10 at the shaft tip 6 of the rotary 2 and at the bearing 7 that inhibits the slipping out, in the axial direction, of the shaft tip 6 of the rotary 2 from the bearing 7.

4 Claims, 4 Drawing Sheets

ROTARY MOUNTING STRUCTURE FOR TONER CARTRIDGE

FIELD OF THE INVENTION

The present invention relates to a toner cartridge comprising a rotary, which is provided with an agitator that agitates a toner, and a bearing that rotatably supports a shaft tip of the rotary.

BACKGROUND INFORMATION

A toner cartridge used in an image forming device, such as a copying machine, a facsimile machine, and a printer, generally comprises a rotary provided with a plate shaped agitator that agitates a toner, a rotary provided with a transporter for transporting the toner, and the like.

When these rotaries are fixed to the toner cartridge, a shaft tip on the drive side of the rotary, which is the left side end depicted in FIG. 1, is supported by a pivot at the outer side of the toner cartridge, and the other shaft tip, which is the right side end depicted in FIG. 1, is supported by insertion into a pocket shaped bearing formed inside the toner cartridge in a surface opposite the pivot. Furthermore, the rotary generally comprises a flexible member, such as a soft resin, and the mounting of the rotary inside the toner cartridge is performed by inserting the shaft tip of the rotary into the bearing while flexing the rotary.

Nevertheless, there is a risk that the shaft tip of the rotary will completely detach from the bearing on the non-drive side when an external force, such as a shock caused by a drop, acts to flex the rotary, because the rotary of a conventional device comprises a flexible member and its mounting to the toner cartridge is constituted by simply inserting the shaft tip of the rotary into the bearing. In particular, if the rotary is provided with a plate shaped agitator, then the rotary is easily flexed by the pressing of the weight of the toner upon the agitator, which is a problem because the shaft tip of the rotary can easily detach from the bearing. In addition, in the case of a large capacity toner cartridge, the rotary is long in the axial direction, which increases the play in the bearing on the non-drive side, and, consequently, the shaft tip of the rotary easily detaches from the bearing.

The present invention was created with consideration of such problems, and it is an object of the present invention to provide a toner cartridge that has a simple constitution and a low cost, and wherein the shaft tip of the rotary does not detach from the bearing even if an external force is exerted.

SUMMARY OF THE INVENTION

The characteristic constitution of the toner cartridge according to the present invention for achieving these objects is a toner cartridge comprising a rotary provided with an agitator that agitates a toner, and a bearing that rotatably supports a shaft tip of the rotary, comprising a retainer at the shaft tip of the rotary and at the bearing that inhibits the slipping out, in the axial direction, of the shaft tip of the rotary from the bearing.

Namely, according to the above characteristic constitution, a retainer is formed at the shaft tip of the rotary and the bearing, and a toner cartridge can therefore be obtained wherein the shaft tip of the rotary does not easily detach from the bearing. Furthermore, because the retainer is formed at the shaft tip of the rotary and the bearing without the addition of new parts, the toner cartridge according to the present invention can be manufactured at a low cost and without increasing the part count or adversely impacting the ease of assembly.

Another characteristic constitution of the toner cartridge according to the present invention is a toner cartridge comprising a rotary provided with an agitator that agitates a toner, and a bearing that rotatably supports a shaft tip of the rotary, wherein the rotary comprises an engager formed in a hook shape at the shaft tip; and the bearing is formed capable of engaging the engager in the state wherein the engager is compressed and deformed, and has a retainer that inhibits the slipping out of the engager in the axial direction in the normal state.

Namely, according to the above characteristic constitution, the engager formed in a hook is elastically deformed inwardly, the rotary is rotatably supported by the bearing, and then the engager is fixed to the retainer by the restoring force of the engager itself, and it is therefore possible to effectively inhibit the slipping out of the rotary from the bearing. In addition, because the engager is provided at the shaft tip of the rotary, it can be made so that the rotary does not detach from the bearing by just the addition of a slight shape modification to the conventional rotary, and there is no adverse impact on the ease of assembly. In addition, a high fixing accuracy can be obtained with such a constitution.

Furthermore, in another characteristic constitution, the rotary comprises the plate shaped agitator that extends in the axial direction of the rotary shaft; and the agitator is disposed so that it disperses [toner] in the axial direction and is connected and supported by the rotary shaft via a plate shaped supporter provided orthogonal to the axial direction.

In other words, according to the above characteristic constitution, a plate shaped agitator is provided whereupon the weight of the toner easily acts, and it is therefore possible to reliably inhibit the slipping out of the shaft tip of the rotary from the bearing by the application of the present invention to a rotary that easily detaches from the bearing.

DETAILED DESCRIPTION OF THE PREFERRED EMBODIMENTS

Figure 1:
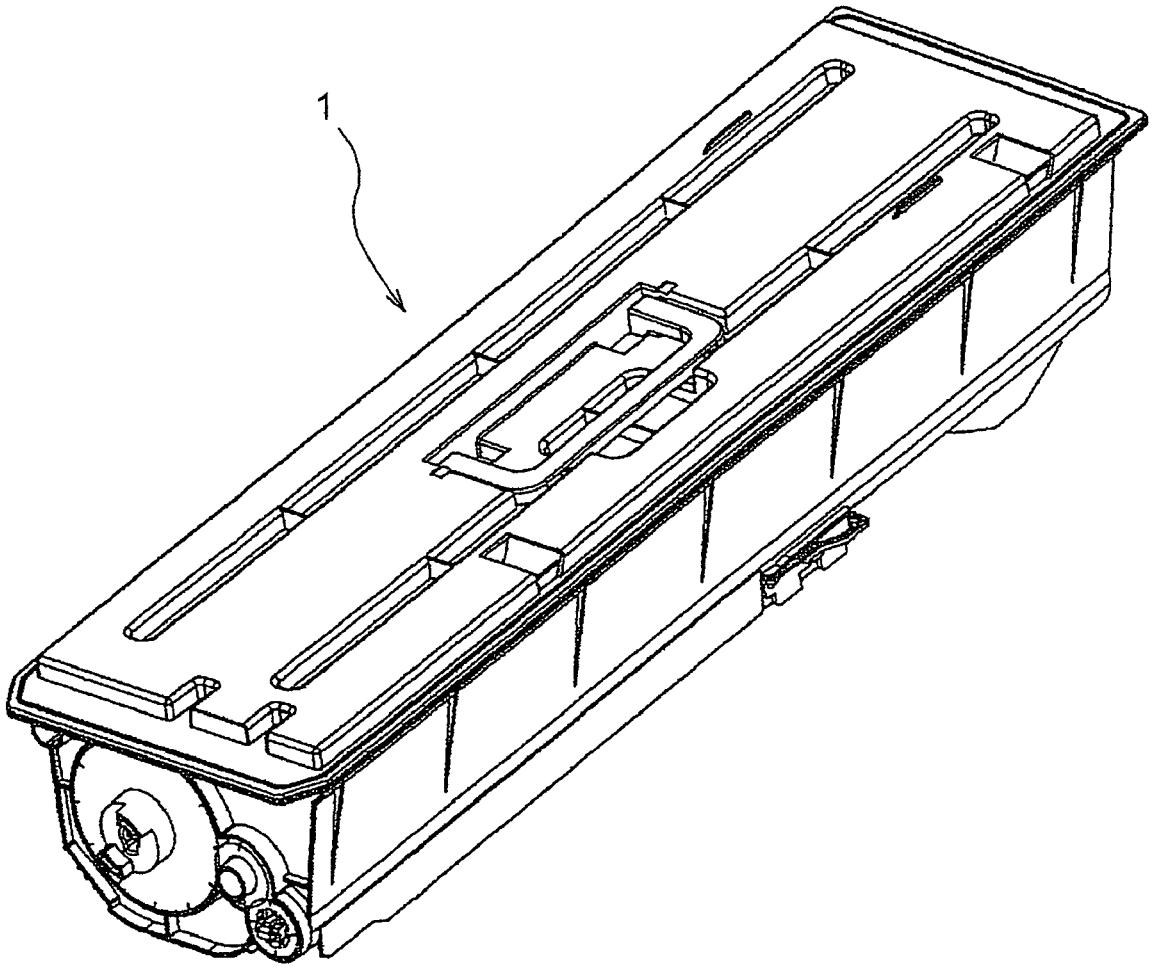
FIG. 1 is an oblique view of a toner cartridge according to the present invention.
Figure 2:
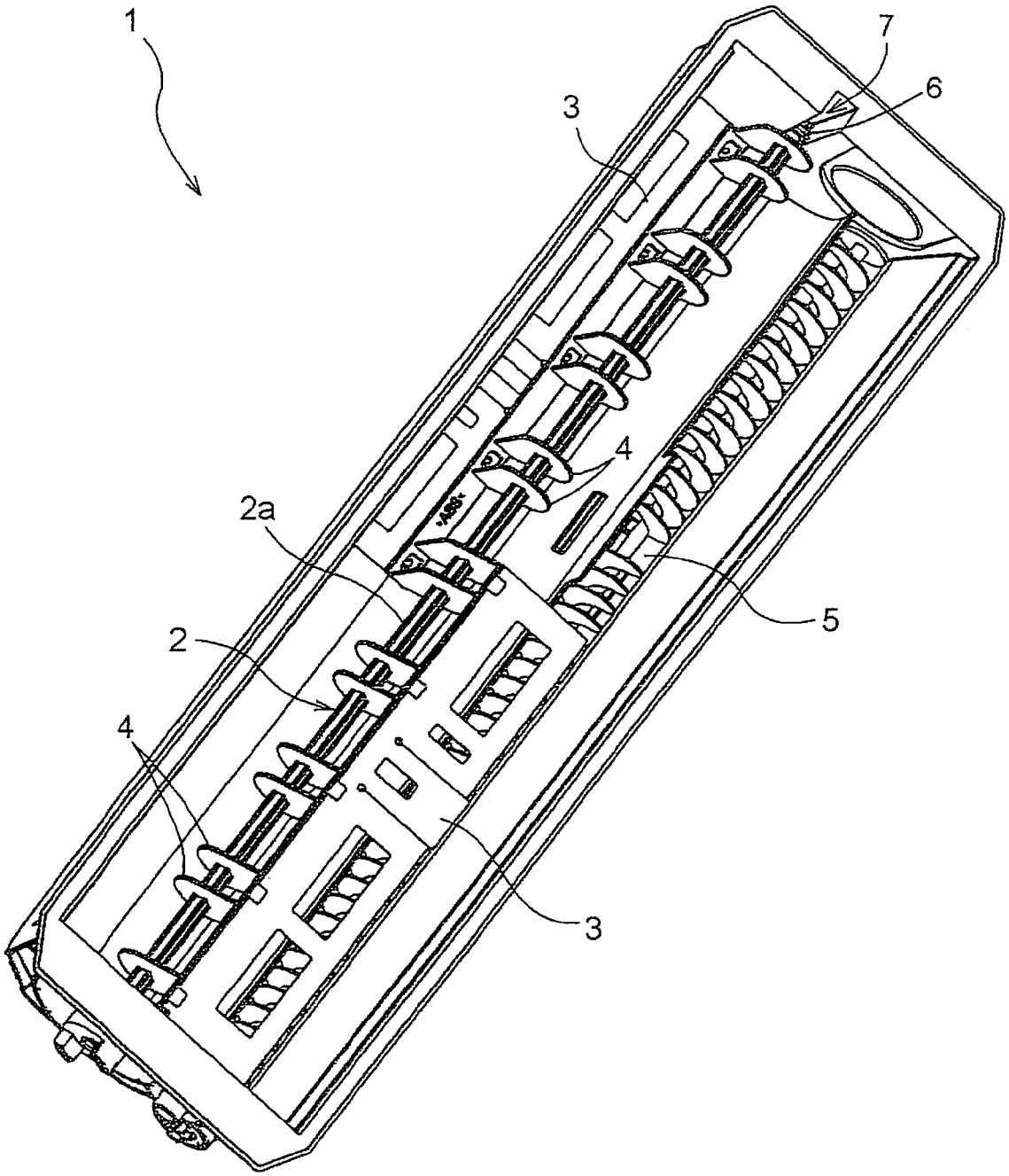
FIG. 2 is an internal structural drawing of a state wherein a cover of the toner cartridge according to the present invention is detached.

The following explains the first embodiment of a toner cartridge according to the present invention, referencing FIG. 1 through FIG. 4. FIG. 1 is a view of the entirety of a toner cartridge 1 according to the present invention, which is used in an image forming device, e.g., a copying machine, a facsimile machine, a printer, and the like. The toner cartridge 1 comprises, inside the main body thereof, a rotary 2 provided with an agitator 3 that agitates a toner, and a bearing 7 that rotatably supports a shaft end 6 of the rotary 2 on the non-drive side thereof, as depicted in FIG. 2. Furthermore, the near side in FIG. 1 is the drive side [of the rotary 2], and the far side is the non-drive side, wherein the bearing 7, which is the subject of the present application, is positioned. Furthermore, the toner cartridge 1 comprises a pivot that supports one end of a rotary shaft 2*a* of the rotary 2 in an outwardly extended state at a surface opposing the bearing 7, i.e., on the drive side. In addition, the toner cartridge 1 comprises, inside the main body thereof, a transporter 5 for transporting the toner, and the like.

The rotary 2 is constituted using a flexible member, and comprises a rotary shaft 2*a* and a plate shaped agitator 3, which extends in the axial direction of the rotary shaft 2*a*. The agitator 3 herein consists of a flexible film, such as polyethylene and polyethylene terephthalate, which is arranged so that it disperses [toner] in the axial direction, and is connected to and supported by the rotary shaft 2*a* via a plate shaped support 4 provided orthogonal to the axial direction. In detail, two agitators 3 are provided to the rotary shaft 2*a*, and these agitators 3 are rectangularly formed and connected to a plurality of plate shaped supports 4 at the long side edges of the agitators 3. The plate shaped supports 4 are formed substantially disc shaped. The two agitators 3 are disposed at opposing positions about the rotary shaft 2*a* in the radial direction, and both are connected to the substantially central plate shaped support 4 so that parts of the agitators 3 overlap in the axial direction.

The rotary 2 comprises an engager 8 that is formed in a hook shape at the shaft end 6. In other words, the engager 8 is preferably integrally formed with the rotary shaft 2*a*. In detail, the engager 8 is formed so that two hooks 8*a*, 8*b* at the tip of the engager 8 oppose one another about the rotary shaft 2*a*. The hooks 8*a*, 8*b* are constituted elastic and deformable inwardly from the diameter of an engaging hole 11 of a retainer 10, which is formed in the bearing 7. A surface on the hook 8*a* that is orthogonal to the rotary shaft 2*a* of the rotary 2 constitutes a contact part 9*a*, and likewise a surface on the hook 8*b* that is orthogonal to the rotary shaft 2*a* constitutes a contact part 9*b*. In a state wherein the engager 8 is inserted through the engaging hole 11 of the retainer 10, these contact parts 9*a*, 9*b* contact the retainer 10 and inhibit the shaft end 6 from slipping out of the bearing 7 when a force acts upon the rotary 2 in a direction so that the engager 8 slips out from the retainer 10. In addition, the engager 8 is formed so that the spacing between the tips of the hooks 8*a*, 8*b* is set smaller than the diameter of the engaging hole 11 formed in the retainer 10, the spacing of the outline portion gradually increases toward the contact parts 9*a*, 9*b*, and the spacing of the outline portion of the contact parts 9*a*, 9*b* is greater than the diameter of the engaging hole 11. By forming [the engager 8] in this manner, the outer diameter parts of the contact parts 9*a*, 9*b* from the tips of the hooks 8*a*, 8*b* serve the function of a guide when inserting the engager 8 into the retainer 10, which makes it easier to engage the engager 8 to the retainer 10.

Here, in the present embodiment, a spacing t between the tips of the hooks 8*a*, 8*b* is set to substantially 3.4 mm, and a diameter d of the rotary shaft 2*a* is set to substantially 5.9 mm. In addition, in the state wherein the shaft end 6 of the rotary 2 is engaged to the bearing 7, the gap w between the contact parts 9*a*, 9*b* of the engager 8 and a contact surface 12 of the retainer 10 when the rotary 2 is in the normal state is set to substantially 2.5 mm in the present embodiment. Furthermore, the spacing between the contact parts 9*a*, 9*b* of the engager 8 and the contact surface 12 of the retainer 10 is set to an appropriate value that takes into consideration the ease of assembly, the fixing accuracy, and the like, of the rotary 2.

Figure 3:
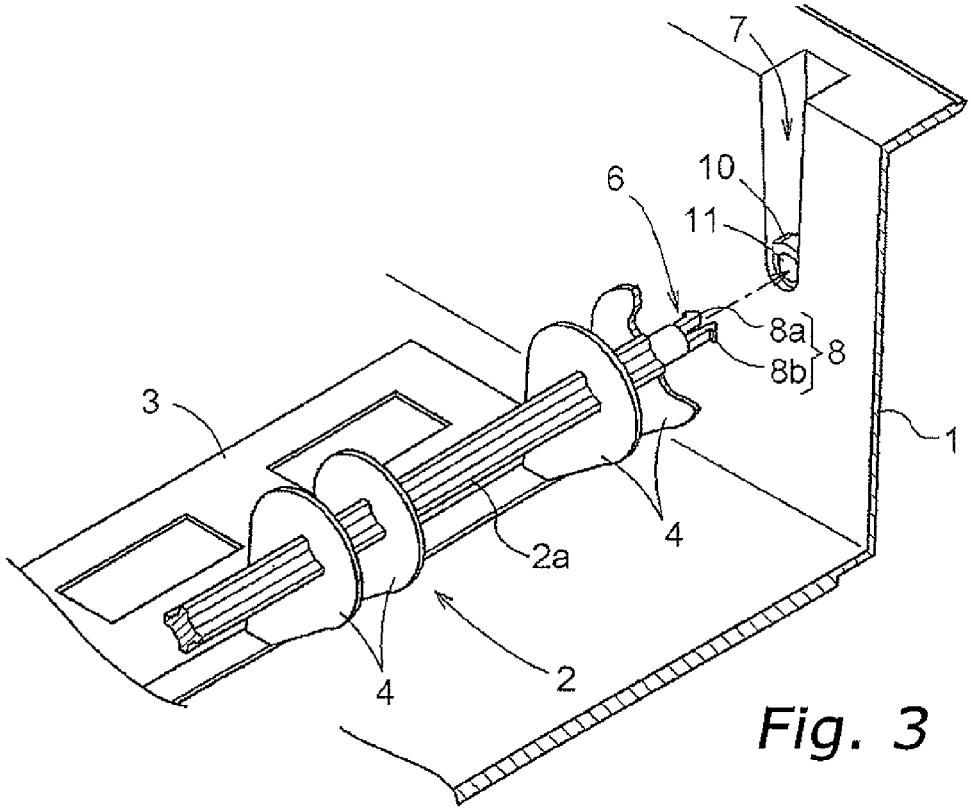
FIG. 3 is an oblique view of the principal parts of the first embodiment of the toner cartridge according to the present invention.
Figure 4:
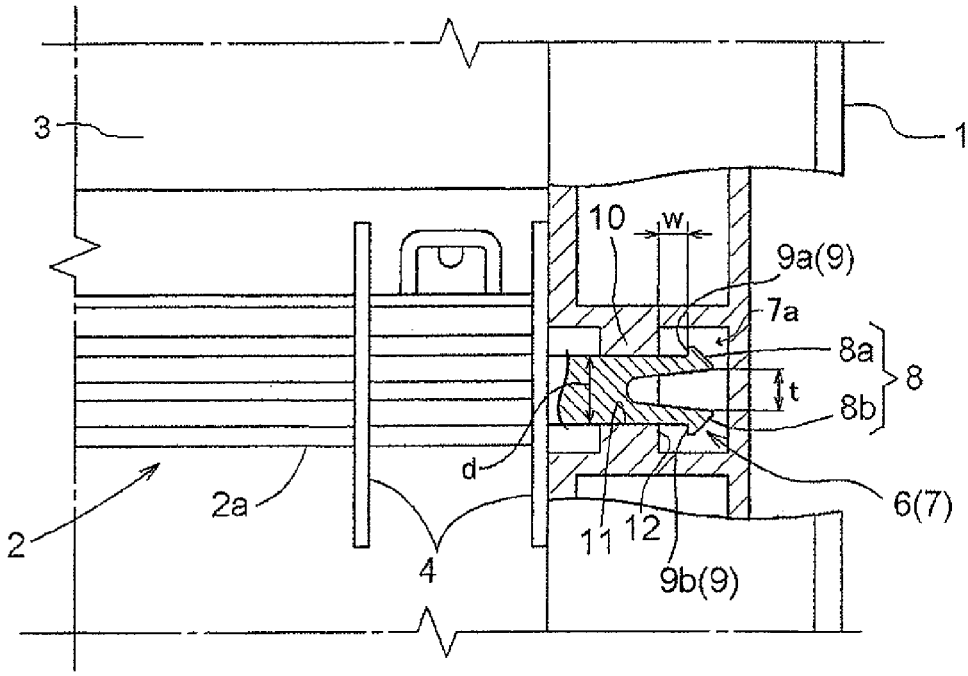
FIG. 4 is a cross sectional view of the principal parts of the first embodiment of the toner cartridge according to the present invention.

As depicted in FIG. 3 and FIG. 4, the bearing 7 is formed substantially pocket shaped, and, in the vicinity of the inner side of the opening thereof, a plate shaped retainer 10, comprising an engaging hole 11 for inserting the engager 8 therethrough, is integrally formed with the main body. Thus, the bearing 7 has an enclosed space 7*a*.The bearing 7 is formed inside the main body of the toner cartridge 1, and the toner does not leak because the bearing 7 does not pass through to the outside. The thickness of the retainer 10 is set to 5 to 6 mm. The diameter of the engaging hole 11 is set in accordance with the diameter of the rotary shaft 2*a* and to a size that ensures that the engager 8 can rotate in its engaged state. In the present embodiment, [the diameter of the engaging hole 11] is set to substantially 6.1 mm. Furthermore, the surface of the retainer 10 in the insertion direction of the engager 8 is constituted as a contact surface 12 that contacts the contact parts 9*a*, 9*b* formed in the engager 8.

The engagement of the engager 8 to the retainer 10 is accomplished by inserting the two hooks 8*a*, 8*b* of the engager 8 through the engaging hole 11, while mutually compressing and deforming them inwardly. Once the engager 8 is inserted through the engaging hole 11, the hooks 8*a*, 8*b* thereof undeform and return to the normal position. In the state wherein [the engager 8 is] inserted through the engaging hole 11, the contact parts 9*a*, 9*b* of the engager 8 contact the contact surface 12 of the retainer 10 and inhibit the slipping out of the engager 8 from the retainer 10, even if the rotary 2 flexes and deforms and the shaft end 6 moves in the axial direction.

Furthermore, in the present embodiment, the engager 8 is provided with two hooks 8*a*, 8*b*, but hooks of an appropriate number and shape are constituted in accordance with: the material, shape, and the like, of the rotary 2; the constitution of the bearing 7; and so on.

Figure 5:
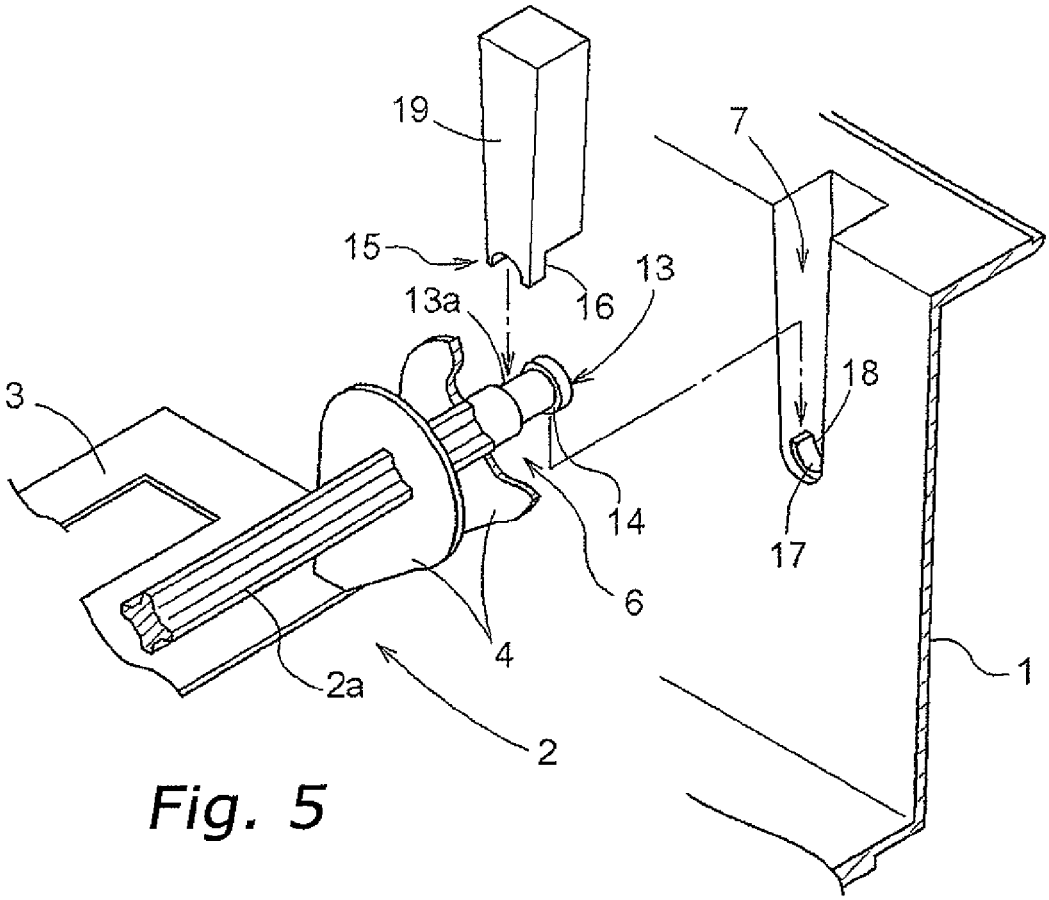
FIG. 5 is an oblique view of the principal parts of another embodiment of the toner cartridge according to the present invention.
Figure 6:
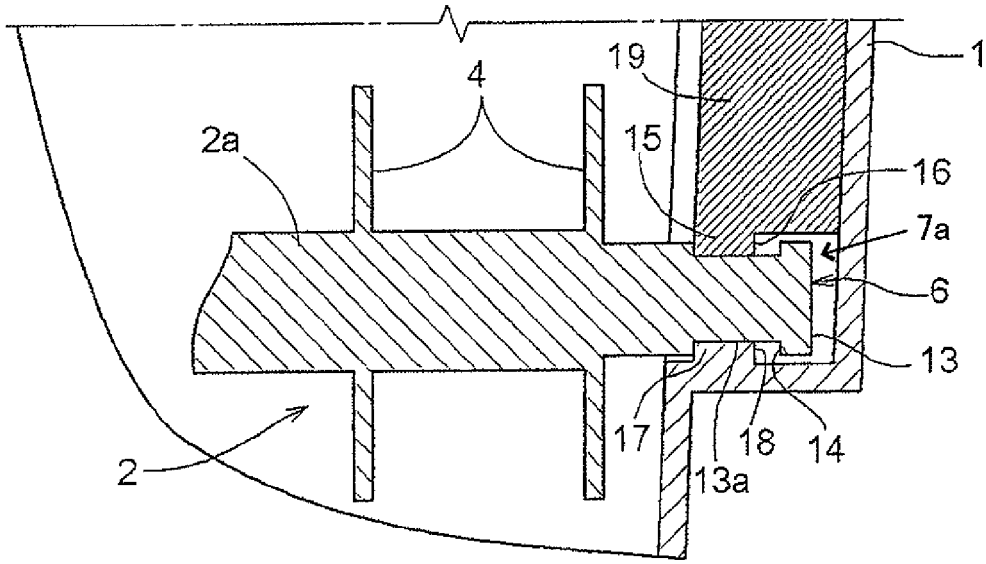
FIG. 6 is a cross sectional view of the principal parts of another embodiment of the toner cartridge according to the present invention.

The following explains another embodiment of the toner cartridge 1 according to the present invention, referencing FIG. 5 and FIG. 6.

In the first embodiment, the hooks 8*a*, 8*b* are provided at the shaft end 6 of the rotary 2 to form the engager 8, and the bearing 7 is provided with a plate shaped retainer 10; however, in the present embodiment, a retainer 15 is provided to a cover 19.

As an engager 13, a groove 13*a* is formed in the rotary 2 of the present embodiment in the circumferential direction at a position of a fixed distance from the tip of the shaft end 6. This groove 13*a* is formed so that a side surface on the tip side is orthogonal to the axial direction of the rotary shaft 2*a*, and constitutes a contact part 14 with respect to the retainer 15.

The retainer 15 of the present embodiment is integrally formed with the cover 19, and is constituted as a presser that presses the engager 13 from the mounting direction of the cover 19 in the mounted state. In detail, a contact surface 16 is formed in the retainer 15 that contacts the contact part 14 of the groove 13*a*, which is formed in the engager 13, when the cover 19 is positioned inside the groove 13*a* in the mounted state and when a force acts upon the rotary 2 so that the engager 13 slips out of the retainer 15.

Furthermore, in the present embodiment, a retainer 17 is formed in the bearing 7 as a presser that presses the engager 13 from the side opposite the mounting direction of the cover 19, and is positioned at the groove 13*a* of the engager 13, in a state wherein the engager 13 is engaged to the bearing 7. In addition, a contact surface 18 is formed in the retainer 17, the same as the retainer 15. Therefore, both the contact surface 16 of the retainer 15 and the contact surface 18 of the retainer 17 contact the contact part 14 of the engager 13, and, consequently, the slipping out of the shaft end 6 from the bearing 7 and enclosed space 7*a* is reliably inhibited.

Furthermore, the width of each of these retainers 15, 17 in the axial direction is set narrower than the groove 13*a* of the rotary shaft 2*a* in the axial direction, and takes into consideration the ease of assembly, fixing accuracy, and the like. In so doing, a toner cartridge 1 can be obtained, wherein the shaft end 6 of the rotary 2 does not slip out from the bearing 7 and the ease of assembly is not adversely impacted, the same as in the first embodiment.

What is claimed is:

1. A toner cartridge, comprising:

a rotary having a rotary shaft, an engager being arranged on a tip of one end portion of the rotary shaft, and an agitator being configured to agitate toner and arranged on an outer periphery of the rotary shaft, the one end portion having an annular groove formed in a predetermined position from the tip of the one end portion; and a bearing having a retainer, and an enclosed space being configured to accommodate the engager, the retainer rotatably supporting the one end portion of the rotary shaft, and restricting movement of the engager in the axial direction of the rotary, the retainer having a first retaining portion being configured to support a lower side of the annular groove, and a second retaining portion being detachable from the first retaining portion and being configured to support the upper side of the annular groove, the engager having a larger width than the one end portion of the rotary shaft supported by the retainer, and the retainer having contact surfaces being contactable with a contact surface of the engager in order to restrict movement of the engager in the axial direction.

2. A rotary support structure, comprising:

a rotary having a rotary shaft and an agitator being configured to agitate toner and arranged on an outer periphery of the rotary shaft, the rotary being provided with an engager on one end portion of the rotary shaft, the engager being formed on the tip of the one end of the rotary; and a bearing rotatably supporting the one end portion of the rotary shaft, restricting movement of the rotary in an axial direction, the bearing having an enclosed space accommodating the one end portion of the rotary shaft, a first supporting portion being configured to support a lower side portion of the one end portion of the rotary, a second supporting portion being formed by another member different from the first supporting portion, and a retainer being configured to restrict movement of the engager in the axial direction, and the enclosed space of the rotary being enclosed on an outer periphery of the rotary and in the direction of the rotary, the engager having a larger-diameter portion being larger in width than the one end portion supported by the bearing and an annular groove formed in a predetermined position from the tip of the one end portion, the retainer having contact faces contacting contact faces of the engager and restricting movement of the rotary in the axial direction, a first retainer formed on the first support portion and configured to support a lower half of a minor diameter formed with the annular groove, and a second retainer formed on the second support portion that is detachable from the first retainer, and configured to support an upper half of the minor diameter, and the contact face of the groove of the engager contacting the contact faces of the first and second retainers to restrict movement of the rotary in the axial direction.

3. A toner cartridge, comprising:

a rotary having a rotary shaft, an engager being arranged on a tip of one end portion of the rotary shaft, and an agitator being configured to agitate toner and arranged on an outer periphery of the rotary shaft, the one end portion having an annular groove formed in a predetermined position from the tip of the one end portion; and a bearing having a retainer, and an enclosed space being configured to accommodate the engager, the retainer rotatably supporting the one end portion of the rotary shaft, and restricting movement of the engager in the axial direction of the rotary, the retainer having a first retaining portion being configured to support a lower side of the annular groove, and a second retaining portion being formed by a member different from the first retaining portion and being configured to support the upper side of the annular groove, the engager having a larger width than the one end portion of the rotary shaft supported by the retainer, and the retainer having contact surfaces being contactable with a contact surface of the engager in order to restrict movement of the engager in the axial direction.

4. A rotary support structure, comprising:

a rotary having a rotary shaft, an engager being arranged on a tip of one end portion of the rotary shaft, and an agitator being configured to agitate toner and arranged on an outer periphery of the rotary shaft, the one end portion having an annular groove formed in a predetermined position from the tip of the one end portion; and a bearing having a retainer, and an enclosed space being configured to accommodate the engager, the retainer rotatably supporting the one end portion of the rotary shaft, and restricting movement of the engager in the axial direction of the rotary, the retainer having a first retaining portion being configured to support a lower side of the annular groove, and a second retaining portion being formed by a member different from the first retaining portion and being configured to support the upper side of the annular groove, the engager having a larger width than the one end portion of the rotary shaft supported by the retainer, and the retainer having contact surfaces being contactable with a contact surface of the engager in order to restrict movement of the engager in the axial direction.

* * * * *